US008499951B1

(12) United States Patent
McDonald et al.

(10) Patent No.: US 8,499,951 B1
(45) Date of Patent: Aug. 6, 2013

(54) BOTTLE HOLDER

(76) Inventors: John McDonald, Stafford, VA (US); Katie M. Supples, Stafford, VA (US)

( * ) Notice: Subject to any disclaimer, the term of this patent is extended or adjusted under 35 U.S.C. 154(b) by 0 days.

(21) Appl. No.: 13/399,966

(22) Filed: Feb. 17, 2012

(51) Int. Cl.
*B65D 23/10* (2006.01)

(52) U.S. Cl.
USPC ..... 215/396; 215/395; 220/737; 220/741; 220/752; 220/754; 220/755; 294/27.1; 294/29

(58) Field of Classification Search
USPC ..... 215/395, 396; 220/694, 710.5, 737, 220/741, 752, 754, 755; D7/622; 294/27.1, 294/29, 32
See application file for complete search history.

(56) References Cited

U.S. PATENT DOCUMENTS

| | | | | |
|---|---|---|---|---|
| 3,884,411 | A | 5/1975 | Carlson et al. | |
| 4,456,451 | A | 6/1984 | Vosper | |
| 4,627,546 | A | 12/1986 | Carranza | |
| 4,666,197 | A | 5/1987 | Watson | |
| 4,724,971 | A | 2/1988 | Henline | |
| 4,896,913 | A | 1/1990 | Kennedy | |
| D391,858 | S | 3/1998 | Dolan et al. | |
| 6,543,825 | B1 | 4/2003 | Dragutin | |
| D512,272 | S | 12/2005 | Avrish | |
| D573,415 | S | 7/2008 | Van Slycke et al. | |
| D581,728 | S | 12/2008 | Logiudice et al. | |
| D628,019 | S | 11/2010 | Brooks | |
| 2010/0065574 | A1* | 3/2010 | Brooks | 220/754 |

FOREIGN PATENT DOCUMENTS

| | | |
|---|---|---|
| CA | 2144598 | 9/1996 |

OTHER PUBLICATIONS

Website, http://www.doohickee.com/shop/page/97shop_param, My Muggie bottle holder, four pages printed from the internet on Nov. 30, 2011.

Website, http://www.luckenbachtexas.com/luckenbach-store/souvenirs-and-gifts/koozies/texas-hold-em-rope-holder, Texas Hold Em Rope Holder, one sheet printed from the internet on Nov. 30, 2011.

* cited by examiner

*Primary Examiner* — Anthony Stashick
*Assistant Examiner* — Madison L Poos
(74) *Attorney, Agent, or Firm* — Richard C. Litman

(57) ABSTRACT

The bottle holder is formed of a synthetic fiber rope, allowing various portions of the rope to be fused together by heat or solvent. The ends of the rope are melted and pressed together to form a relatively large endless loop. The facing portions of this loop are then partially melted and pressed together to form a single fused handgrip portion having loops extending from opposite ends thereof. One loop is preferably larger than the other, the larger loop being adapted to fit around the base of a beverage bottle and the smaller loop being adapted to fit about the bottleneck. The fused central or handgrip portion of this structure is then helically wound with a smaller diameter cord to form a handgrip, the ends of the cord being captured by the juncture of one of the rope loops and by a bight in the cord.

7 Claims, 10 Drawing Sheets

BOTTLE HOLDER

BACKGROUND OF THE INVENTION

1. Field of the Invention

The present invention relates to handles and related articles for holding and carrying various objects, and particularly to a method of constructing a bottle holder formed of a closed length of synthetic rope, and to the finished article.

2. Description of the Related Art

Generally speaking, the manufacturers of various goods that are packaged at the time of manufacture are not particularly concerned with the convenient packaging of their products. This is primarily for reasons of economy, as the modification of the packaging to provide more convenient handling will generally cost more to manufacture and place the manufacturer or the packager at an economic disadvantage in the marketplace. There are some exceptions to the rule, generally in cases of larger and bulky goods, such as liter-size and larger bottles that often have a handle formed integrally with the container, but the lack of convenient handling means is nearly universally true for smaller individual containers.

An example of such is the standard beer or soda bottle. Such bottles are very economically formed of inexpensive glass or plastic, and have no additional features to facilitate their handling. As the beverages contained therein are generally served at well below ambient temperature, the bottles are subject to condensation on their outer surfaces. The wet outer surface of such a bottle may lead to various problems, such as leaving a circle of condensed water on the surface where the bottle was resting. While this may be of no consequence in most casual outdoor settings, such condensation rings can permanently stain and disfigure some finished wood and/or fabric surfaces and the like. Moreover, the wet outer surface of the bottle may result in the bottle slipping from the hand, thus resulting in at least the spillage of the drink and likely the breakage of the bottle as well. This is a primary reason that glass bottles are prohibited in many areas, such as swimming pools and the like.

As a result, a number of different temporary, removable holders and handles for individual containers have been developed in the past. Some of these devices comprise thermally insulated sleeves with closed bottoms that extend partially up the sides of the bottle or can. While such devices may obviate the problem of condensation marks on a surface, they do not necessarily provide a good grip for the person holding the container and sleeve assembly, particularly for small children. Their smaller hands may not be able to grip the container when they attempt to handle the larger diameter of a soft drink can or bottle and the insulated sleeve therearound.

Accordingly, various external handles for individual serving size bottles and cans have been developed in the past. Such devices are invariably formed of materials that result in additional cost to manufacture and additional time and effort in the manufacturing process. As a result, they are not particularly economical to purchase. The result is that these devices are not as popular as they might be if they could be manufactured more economically.

Thus, a bottle holder solving the aforementioned problems is desired.

SUMMARY OF THE INVENTION

The bottle holder comprises an endless loop of relatively heavy rope formed of synthetic fiber. The endless loop is formed by melting the ends of a length of such synthetic fiber rope, and fusing the ends together. Facing sides of this loop are then heated or softened with solvent to melt them partially, and the melted surfaces are pressed together to form a larger thickness center or handle portion having two mutually opposed smaller bottle gripping loops extending therefrom. Preferably, one of the bottle gripping loops is larger than the other, the larger end loop being adapted to fit about the base of a beverage bottle and the smaller loop being adapted to fit about the neck of the bottle. Preferably, the fused joint that was made to form the initial larger endless loop is located in the area of the fused center area.

The fused center area, which forms the handgrip portion of the holder, is then wrapped with a relatively small diameter cord to provide a more comfortable grip and for esthetic purposes. The cord is laid out along the fused central portion of the larger diameter rope, and a bight or loop is formed overlying the juncture of one of the end loops, preferably the larger of the two loops. One portion of the cord is longer than the other, the longer portion being wrapped around the fused central portion of the rope from one end loop to the other. The end of the longer portion of the cord is passed through the bight of the cord and tucked into the juncture of the adjacent end loop. The opposite end of the cord extends from the initial end of the wrap and is pulled to tighten the bight around the first end to further secure the cord about the central portion of the device. The ends of the cord are then trimmed to complete the holder. The result is a bottle holder that is devoid of mechanical fasteners, clips, and the like, and further devoid of adhesives, other than the fusing of the materials by heat or solvent.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The bottle holder provides an economical and reusable device for efficiently holding a glass or plastic beverage bottle or the like, greatly facilitating the handling of the bottle by the consumer and greatly reducing the chances that the bottle may be dropped by slipping from the hand of the consumer.

Figure 1:
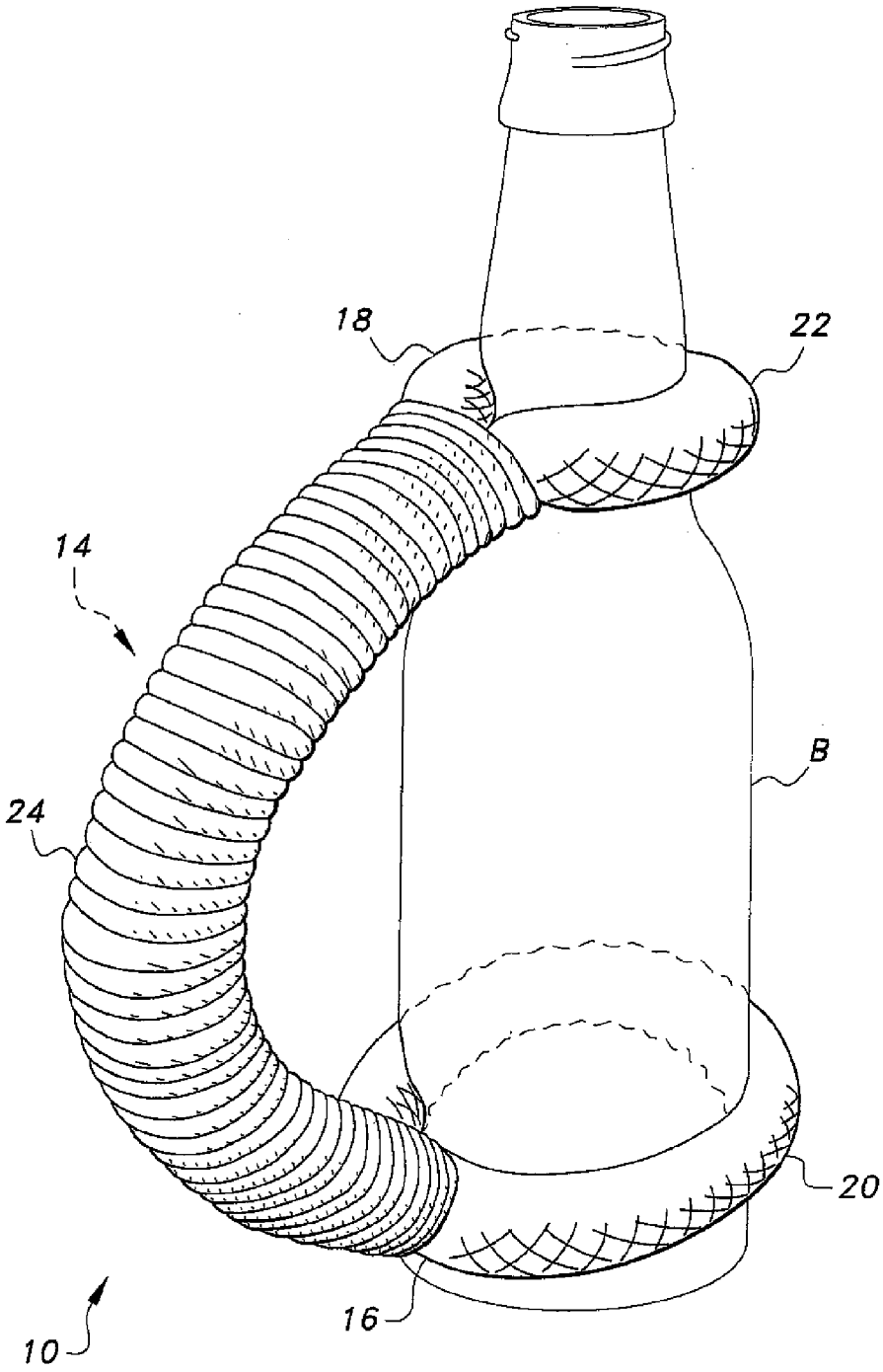
FIG. 1 is an environmental, perspective view of a bottle holder according to the present invention, illustrating its general features.
Figure 2:
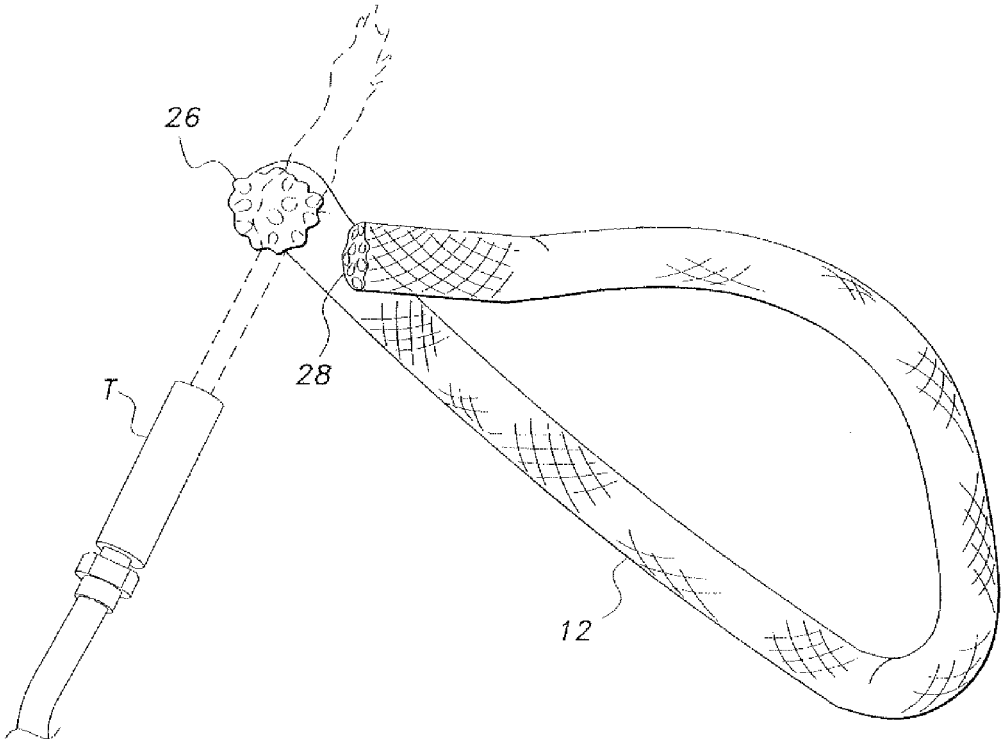
FIG. 2 is a perspective view generally showing an early step in a method of constructing the bottle holder of FIG. 1.

FIG. 1 provides an environmental perspective view of the completed bottle holder 10 in use, shown as it would be temporarily and removably installed upon a glass or plastic beverage bottle B. Subsequent drawings illustrate the steps involved in making the bottle holder 10. The bottle holder 10 comprises a length 12 (as shown in FIG. 2) of relatively heavy rope or the like. The ends of the rope are joined to form a closed loop, and the opposite sides of the loop are then joined to one another to form a central handgrip portion 14. The handgrip portion has mutually opposed first and second ends 16 and 18 having mutually opposed first and second bottle gripping loops 20 and 22 extending therefrom, generally as shown in FIG. 1 of the drawings. It will be noted that the first bottle gripping loop 20 has a larger diameter than the second bottle gripping loop 22. The first loop 20 is adapted to fit about the larger diameter base portion of the bottle B, and the smaller second loop 22 is adapted to fit about the smaller diameter neck of the bottle, the loops 20 and 22 frictionally engaging the bottle to secure the bottle holder 10 to the bottle. The central handgrip portion 14 is wrapped with a smaller diameter cord 24 helically wound about its handle midsection to complete the bottle holder 10.

The length of rope 12 is formed of a synthetic plastic fiber, e.g., nylon, polypropylene, etc. The rope 12 comprises a synthetic fiber material that may be at least partially melted or partially dissolved by heat, solvent, or in some other manner during construction of the bottle holder 10 in order to melt and fuse portions of the rope 12 to one another. Such melting and fusing cannot be accomplished with rope formed of natural materials.

Figure 3:
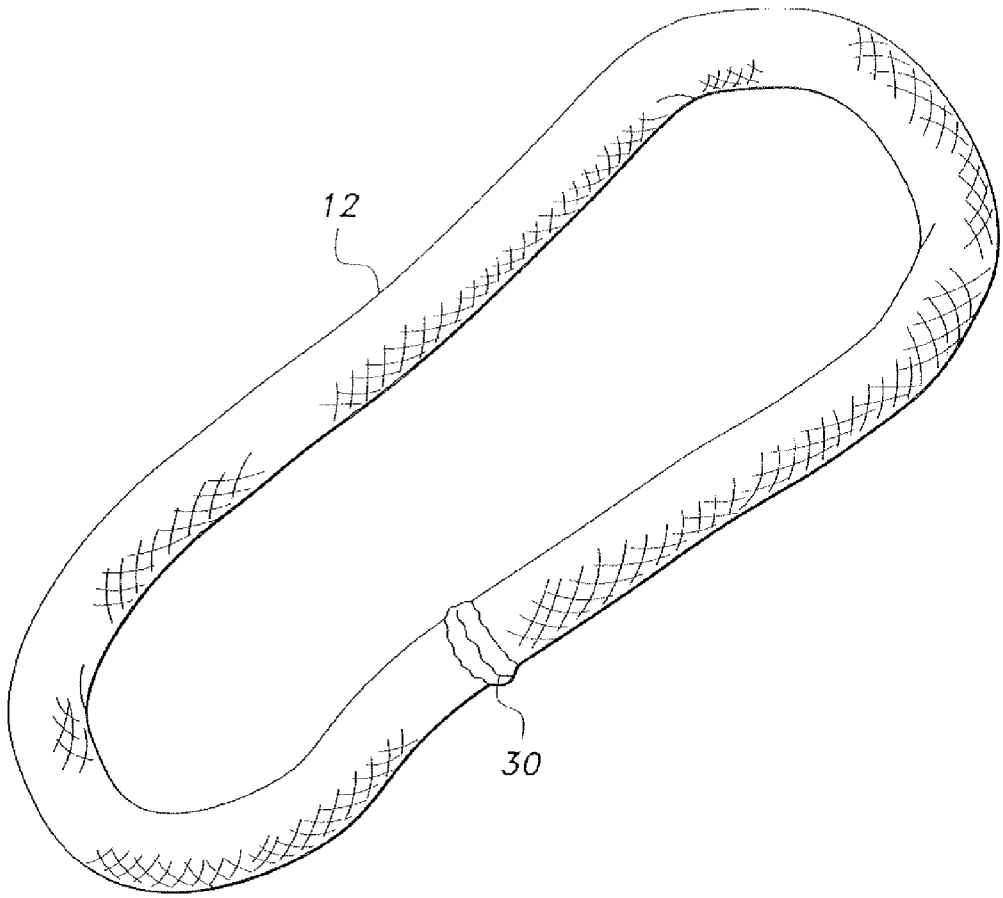
FIG. 3 is a perspective view of a component of the bottle holder according to the present invention, after the completion of the construction step of FIG. 2, showing formation of a single large loop.
Figure 4:
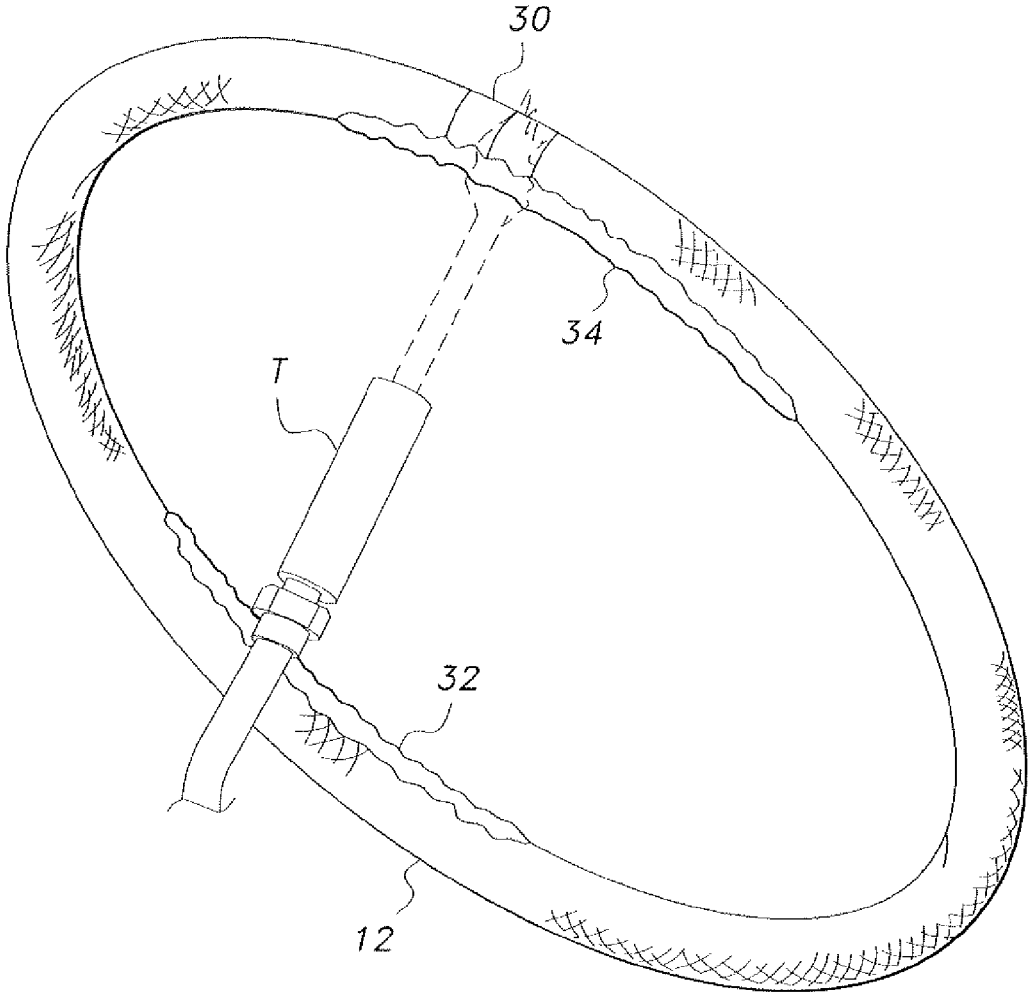
FIG. 4 is a perspective view of a successive step in the method of constructing a bottle holder according to the present invention, showing application of heat to portions of the large loop of FIG. 3.

FIG. 2 of the drawings illustrates the first step in the manufacture of the bottle holder 10, i.e., melting the opposite first and second ends 26 and 28 of the rope length 12 with a propane torch T (or other suitable heat source, as desired) to join them together. The fused joint 30 of the resulting closed loop is shown in FIGS. 3 and 4. This initial step in the construction is designated as step 100 in the flowchart of FIG. 10 generally describing the steps in the method of manufacture of the bottle holder 10. Alternatively, a chemical solvent could be used to partially dissolve the ends 26 and 28 of the rope length 12 so that the softened and partially dissolved ends 26, 28 can then be pushed together to fuse them together.

Figure 5:
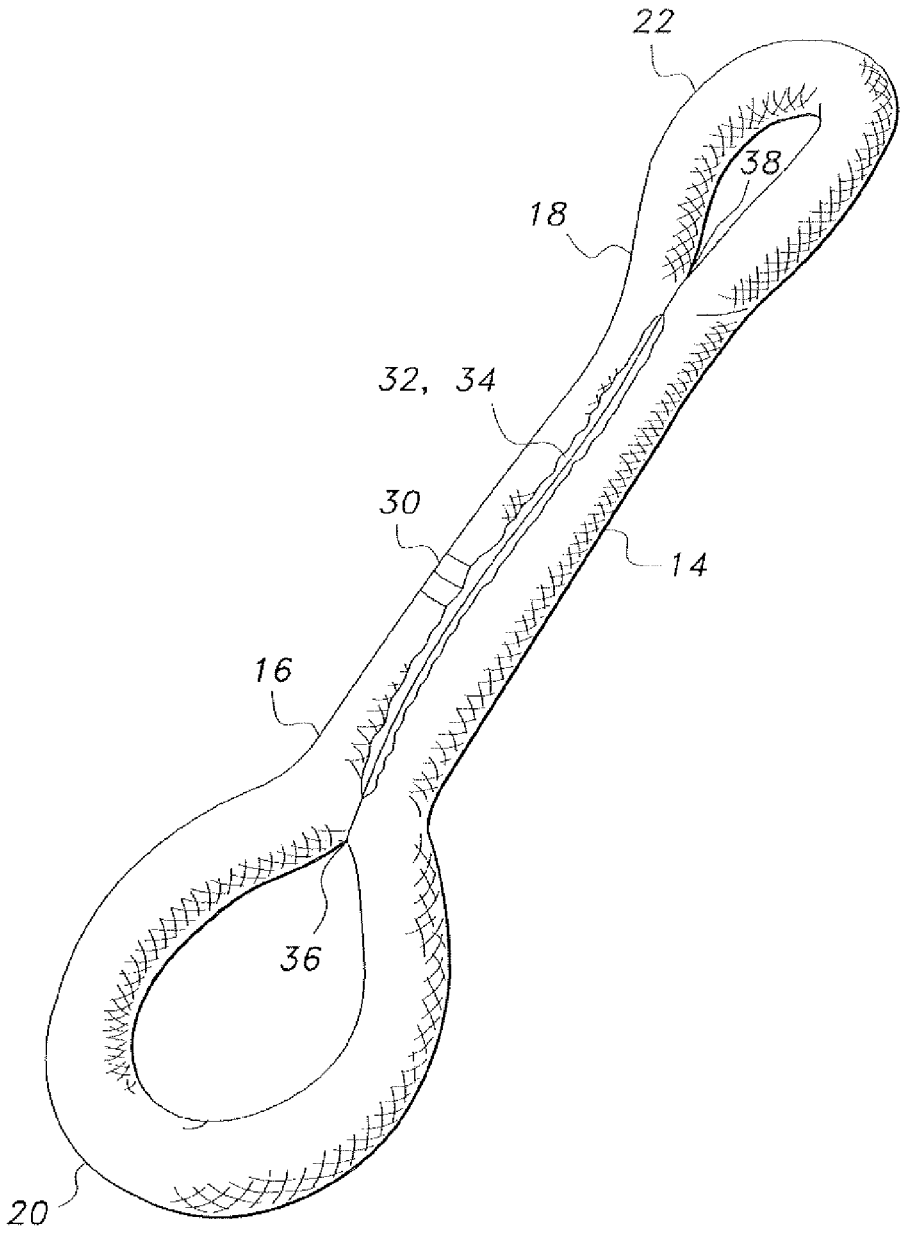
FIG. 5 is a perspective view of the component of bottle holder according to the present invention after the completion of the construction step of FIG. 4, showing fusion of central segments of the large loop to form two end loops.
Figure 10:
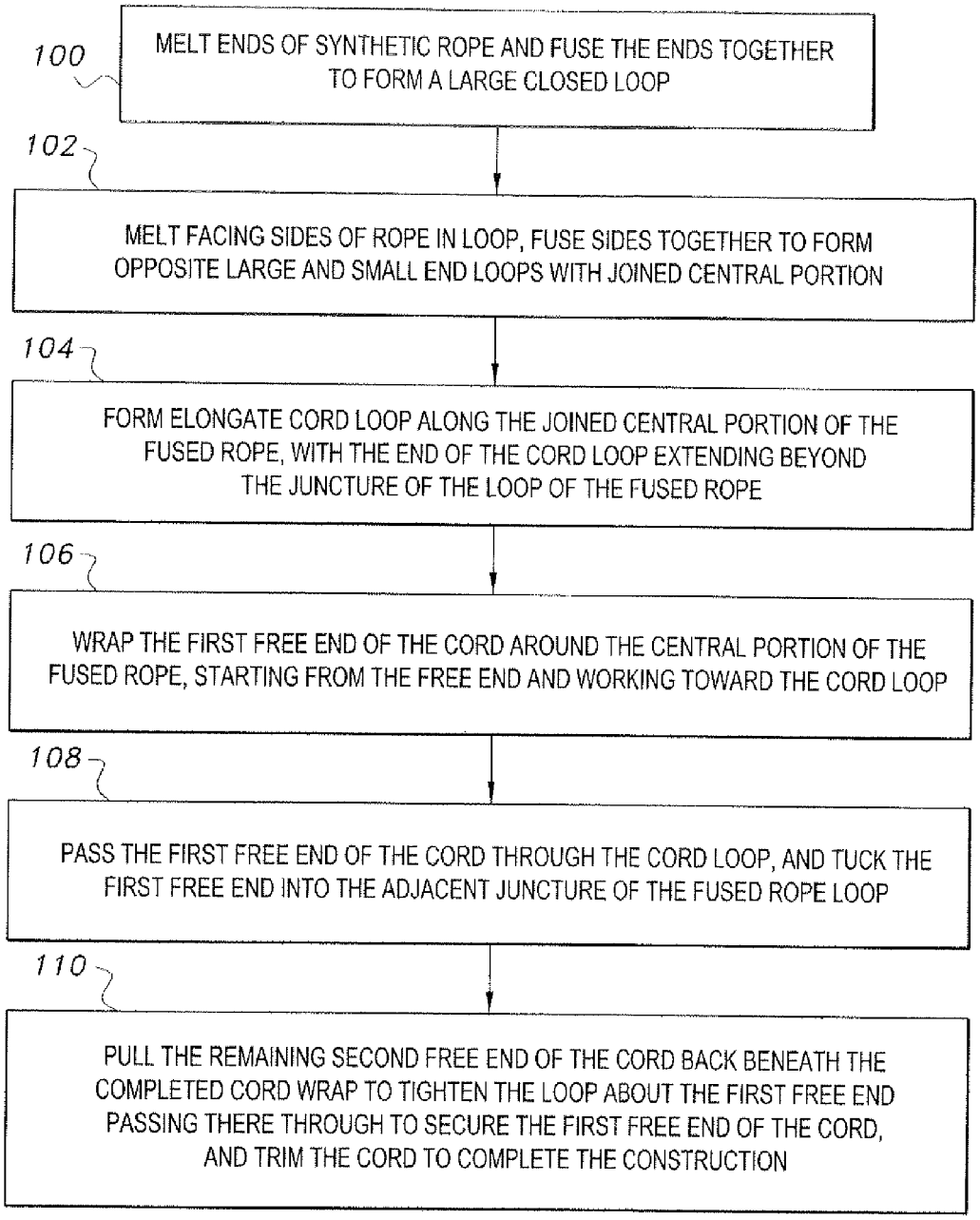
FIG. 10 is a flowchart briefly describing the steps in the method of constructing a bottle holder according to the present invention.

At this point in the construction, the opposite side portions of the rope length 12 are partially melted using a propane torch T or other suitable heat source, generally as shown in FIG. 4 and described in FIG. 10. Again, partial dissolution of these portions of the closed loop rope length 12 may be achieved by a chemical solvent, if desired. The two partially melted portions 32 and 34 are then pressed or squeezed together to fuse the two portions to one another, resulting in the rope illustrated in FIG. 5, having a central handle portion 14 and opposite first and second bottle gripping loops 20 and 22. Preferably, the previously formed joint 30 is positioned along one of the partially melted portions, which will be concealed by the cord wrap 24 when the bottle holder 10 is completed. It will be noted that each of the bottle gripping loops 20 and 22 forms an angularly narrow throat 36, 38 at the respective ends 16 and 18 of the central handle portion 14 of the rope. The angularly narrow throats 36, 38 play a part in securing the cord wrap 24 about the handle portion 14, as explained further below.

Figure 6:
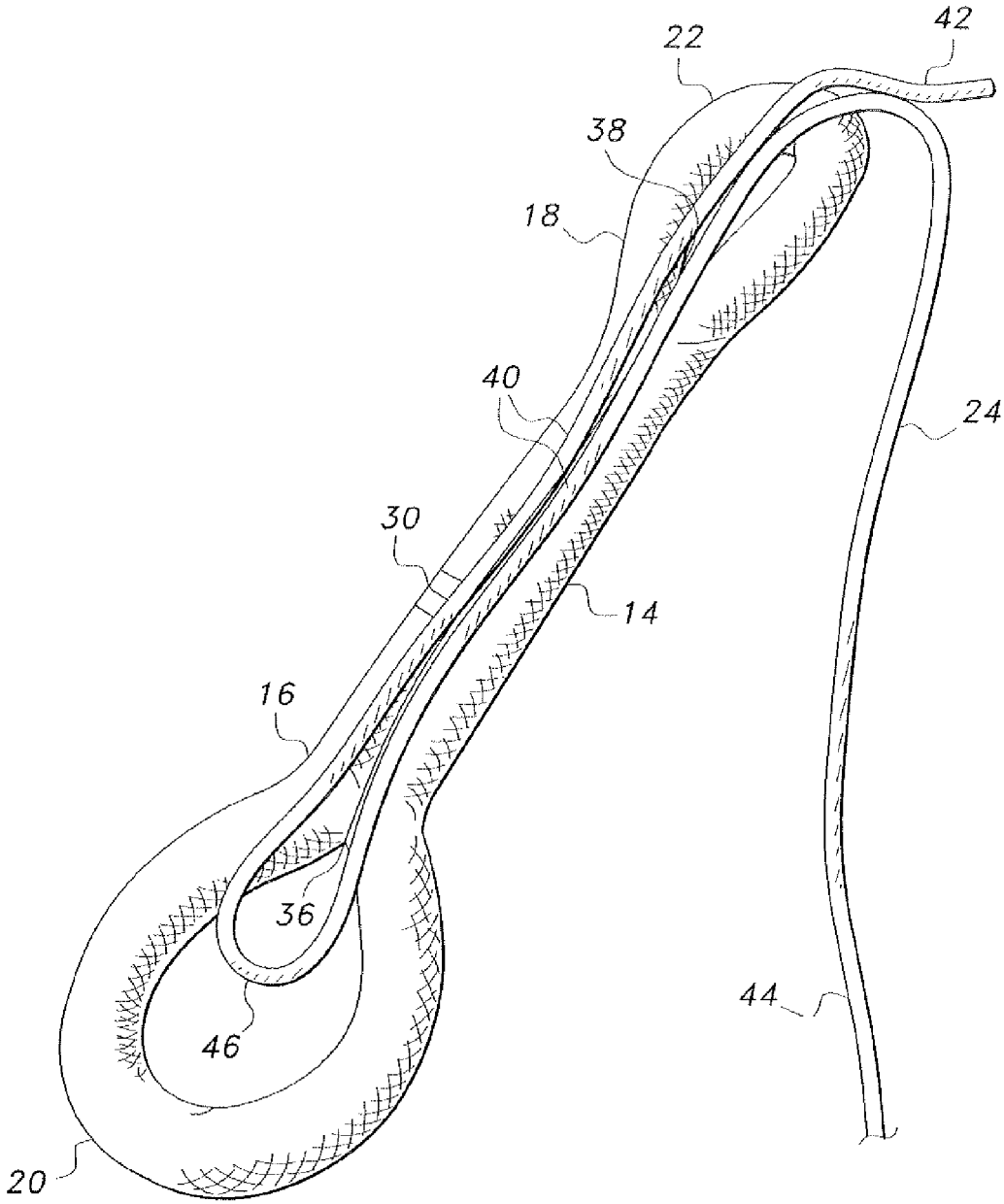
FIG. 6 is a perspective view of another successive step in the method of constructing a bottle holder according to the present invention, showing initial steps in forming a grip around the central section of the holder of FIG. 5.

The procedure for wrapping the central handle portion 14 of the rope with cord is initiated as shown in FIG. 6 of the drawings. A doubled length or portion 40 of the cord 24 in the form of an elongate loop is initially laid out along the length of the central handle portion 14 so that a shorter end portion 42 and a longer portion 44 of the cord extend beyond the throat 38 of the second bottle gripping loop 22. The longer portion 44 of the cord 24 remains free for the time being, as it will be wrapped circumferentially about the handle portion 14 of the rope, as described further below. The two portions of the cord 24 that form the doubled portion 40 also form a bight or loop 46, which is positioned to overlay the throat 36 of the first bottle gripping loop 20. It will be seen that the orientation of the cord 24 in the example described herein could be reversed so that the bight 46 overlays the throat 38 of the second bottle gripping loop 22 and the opposite two ends 42 and 44 of the cord 24 extend beyond the throat 36 of the first bottle gripping loop 20, if desired.

Figure 7:
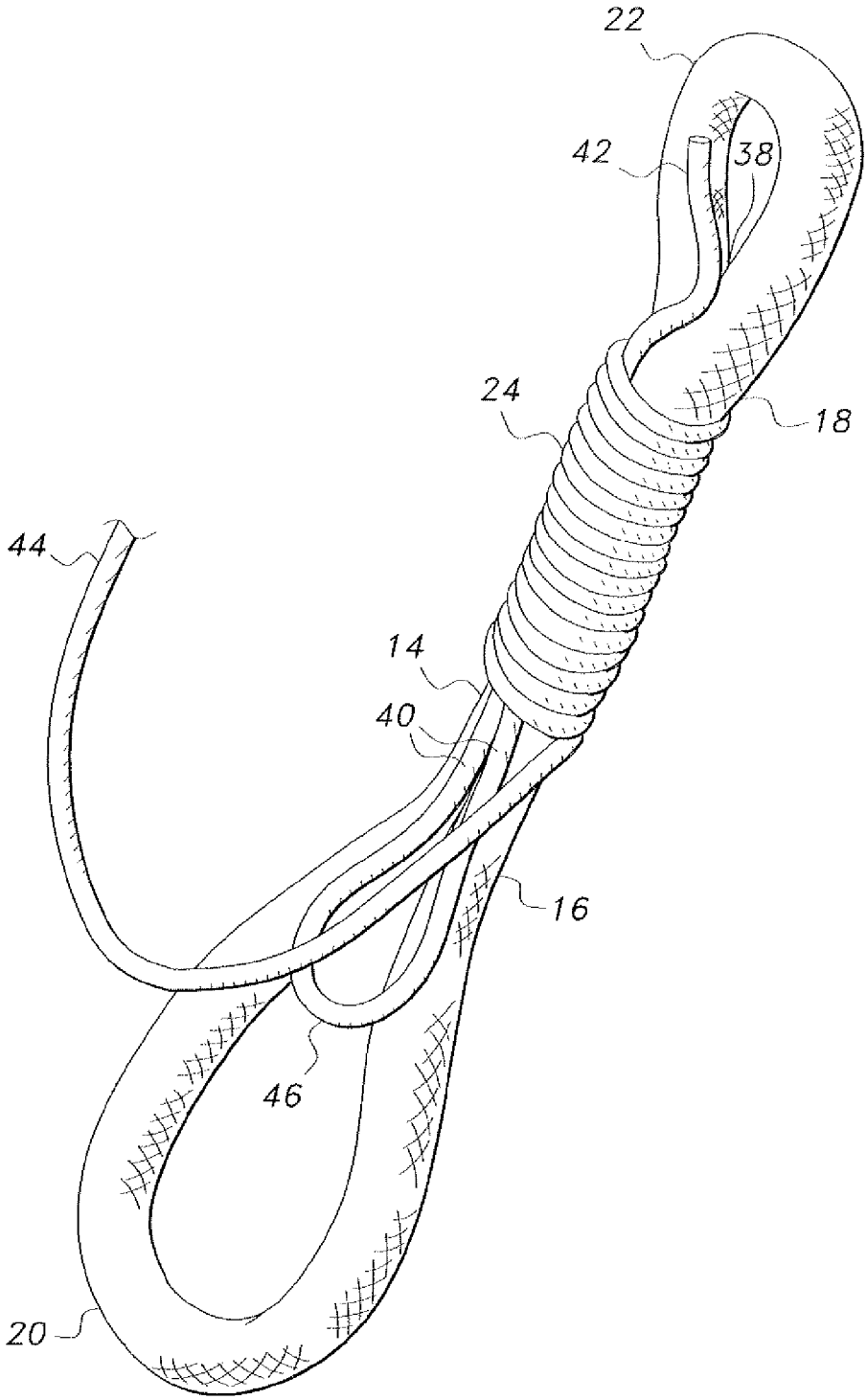
FIG. 7 is a perspective view of another successive step in the method of constructing a bottle holder according to the present invention, showing a cord being helically wound around the fused central segments of FIG. 6 to form the grip.

At this point the wrapping of the handle portion 14 of the rope is begun by wrapping the longer portion 44 of the cord 12 circumferentially about the handle portion 14 of the rope, generally as illustrated in FIG. 7 and described in the fourth step 106 of FIG. 10. The wrap is helically wound around the fused central portion so that each successive turn is placed immediately in contact with the previous turn, working toward the opposite end of the handle portion 14 and the cord bight 46, thereby forming a grip around the central portion 14.

Figure 8:
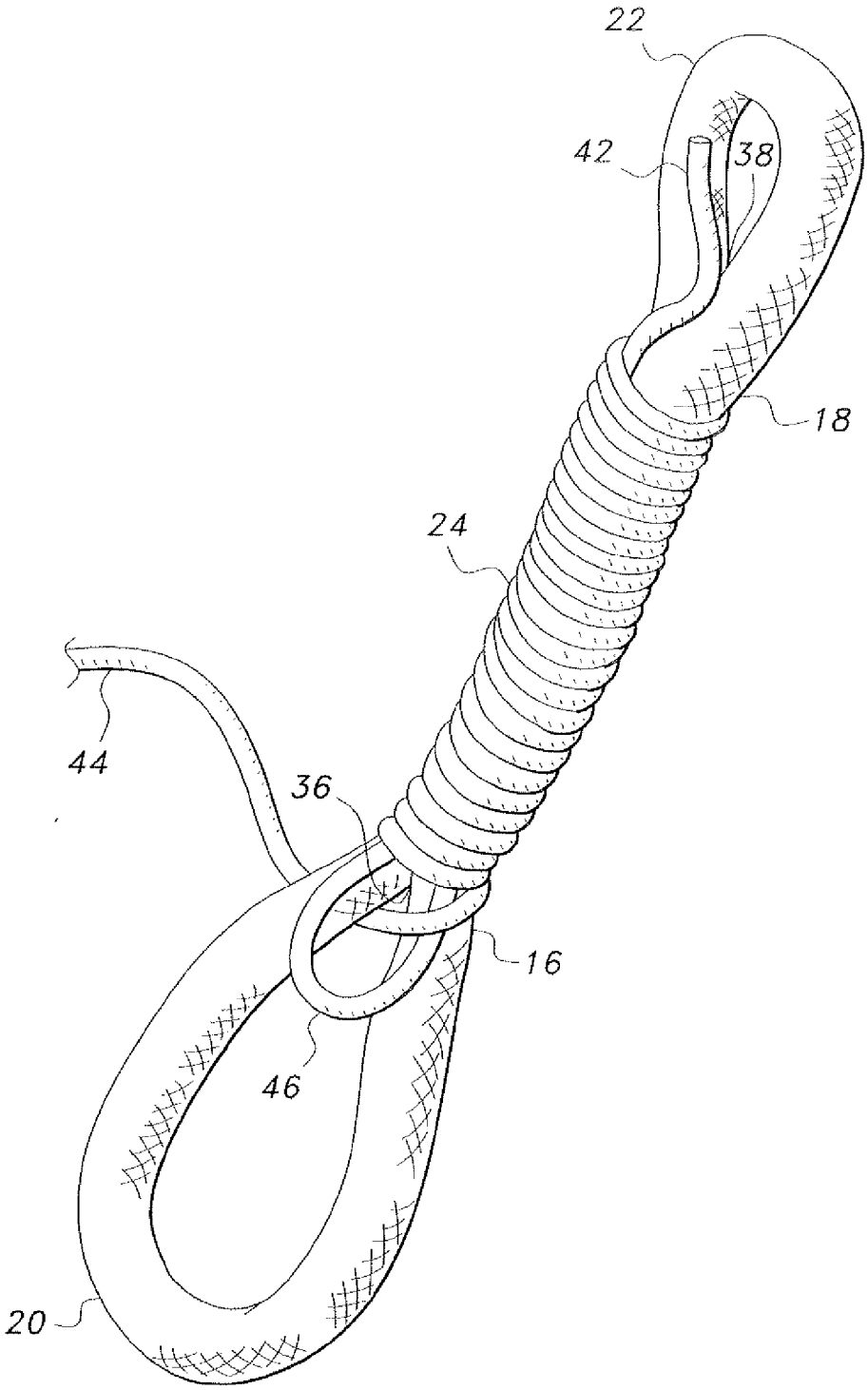
FIG. 8 is a perspective view of another successive step in the method of constructing a bottle holder according to the present invention, showing a first end of the grip being secured through a bight.
Figure 9:
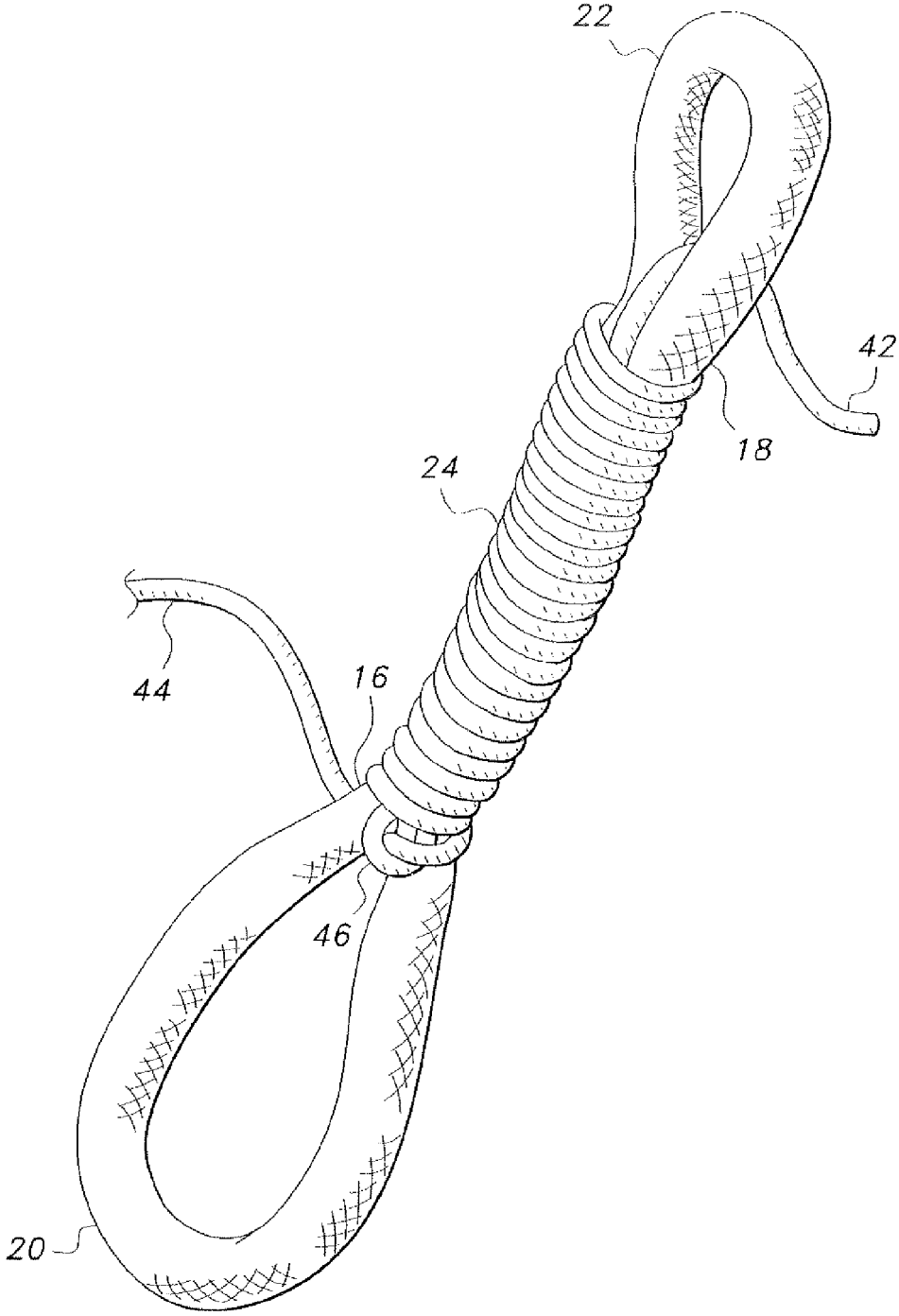
FIG. 9 is a perspective view of one of the final steps in the method of constructing a bottle holder according to the present invention, showing the opposite end of the grip being tucked through the neck end loop after tightening the bight.

When the wrap has reached the opposite end of the handle portion of the rope, the remaining free end 44 of the cord wrap 24 is passed through the bight 46 at that end of the device, generally as shown in FIG. 8. The free end 44 of the cord wrap 24 is then pulled tightly down into the angularly narrow throat 36 of the bottle gripping loop 20, generally as shown in FIG. 9 of the drawings. This procedure of passing the free end 44 of the cord through the bight 46 and drawing the free end 44 tightly into the throat 36 of the bottle gripping loop 20 is described generally in the fifth step 108 of the flowchart of FIG. 10.

The cord wrap 24 is completed by tightening the bight 46 about the remaining free end portion 44 of the cord 24 to capture the free end 44 securely and prevent it from unwrapping. The wedging or jamming of the free end portion 44 into the throat 36 of the bottle gripping loop 20 serves to lock this free end 44 securely, but the tight capture of the free end 44 by tightening the bight 46 therearound provides additional insurance against the cord unwrapping. The bight 46 is tightened by drawing the opposite short end 42 of the cord wrap 24 from its extension from beneath the cord wrap 24 at the second end 18 of the handle portion. As the short end 42 of the cord wrap 24 extends beneath the now completed cord wrap to the opposite end thereof, pulling the short end 42 will also tighten the loop of the bight 46. The short end 42 of the cord wrap 24 is then wedged securely into its corresponding adjacent throat 38 of the second bottle gripping loop 22, just as its counterpart end 44 was wedged into the opposite throat 36 of the bottle gripping loop 20.

When the above steps have been completed, the two remaining ends 42 and 44 of the cord wrap 24 are trimmed to eliminate loose ends, completing the construction of the bottle holder 10 illustrated in FIG. 1. The final step comprising the tightening of the bight 46 about the free end 44 of the cord wrap 24 and the trimming of the ends 42 and 44 of the cord wrap 24 are described generally in the final sixth step 110 of the flowchart of FIG. 10. The construction shown and described herein may be adapted to any practicable diameter and length of rope and cord, as desired. Thus, the device is not necessarily limited only to single-serving beverage bottles, but may be adapted to hold larger bottles of different shapes and configurations. The result is a bottle holder 10 that is economical to manufacture, durable, and that provides the consumer with a much more positive grip and control over a beverage bottle or the like.

It is to be understood that the present invention is not limited to the embodiments described above, but encompasses any and all embodiments within the scope of the following claims.

We claim:

1. A method of constructing a bottle holder, comprising the steps of:

(a) melting two opposed ends of a length of synthetic fiber rope;

(b) fusing the melted ends of the length of rope together to form an endless closed loop having a fused joint;

(c) melting diametrically opposite facing portions of the loop, one of the facing portions containing the fused joint; and (d) fusing the two melted facing portions of the loop together, thereby forming a central handle portion and mutually opposed first and second bottle gripping loops extending therefrom, each of the gripping loops having a narrow throat adjoining the central handle portion, the gripping loops being dimensioned and configured for gripping a bottle.

2. The method of constructing a bottle holder according to claim 1, wherein the first bottle gripping loop has a larger diameter than the second bottle gripping loop.

3. The method of constructing a bottle holder according to claim 1, further comprising the steps of:

(a) forming a doubled length of cord to define an elongate end, a short end, and a bight;

(b) positioning the doubled length of cord along the fused handle portion with the bight of the cord disposed over the throat of the first bottle gripping loop and the elongate and short ends of the cord extending beyond the throat of the second bottle gripping loop; and (c) helically winding the elongate end of the cord about the fused handle portion from the bottle gripping loop opposite the bight of the cord along the handle portion to the bottle gripping loop at the bight of the cord to form a grip around the fused handle portion.

4. The method of constructing a bottle holder according to claim 3, further comprising the steps of:

(a) passing the elongate end of the cord through the bight of the cord; and (b) pulling the short end of the cord, thereby capturing the elongate end of the cord within the bight of the cord by drawing the bight about the elongate end of the cord.

5. The method of constructing a bottle holder according to claim 3, further comprising the step of securing the elongate end of the cord in the throat of the first bottle gripping loop.

6. A bottle holder, comprising:

an elongate central handle portion having a first bottle gripping loop and a second bottle gripping loop extending from opposite ends thereof, the central handle portion, the first bottle gripping loop, and the second bottle gripping loop being formed of a single continuous length of synthetic rope having opposite ends thereof fused together at a fused joint to form an endless loop, the central handle portion including the fused joint and being formed from fused central portions of the endless loop;

a cord helically wound about the central handle portion from the first bottle gripping loop to the second bottle gripping loop to form a grip;

each of the bottle gripping loops forms an angularly narrow throat with the corresponding end of the central handle portion; and the cord further comprises a doubled length extending along the central handle portion, the cord defining a bight disposed over the throat of the first bottle gripping loop, the cord further having a first end passing through the bight, the bight securing the first end of the cord in the throat.

7. The bottle holder according to claim 6, wherein the first bottle gripping loop has a larger diameter than the second bottle gripping loop.

* * * * *